United States Patent [19]

Fielding, Sr.

[11] 4,134,614

[45] Jan. 16, 1979

[54] MOBILE EASEL AND SEATING MEANS

[76] Inventor: Gordon W. Fielding, Sr., 41 Lone Pine Path, Weymouth, Mass. 02188

[21] Appl. No.: 812,323

[22] Filed: Jul. 1, 1977

[51] Int. Cl.[2] ..... A47B 97/04; A47B 39/00

[52] U.S. Cl. ..... 297/156; 248/118; 248/448; 248/458; 297/172

[58] Field of Search ..... 297/156, 241, 135, 172, 297/170; 248/448, 455, 415, 458, 449, 242, 217, 118; 312/231, 233; 108/103

[56] References Cited

U.S. PATENT DOCUMENTS

| | | | |
|---|---|---|---|
| D. 175,016 | 6/1955 | Cote | 297/156 X |
| 1,640,380 | 8/1927 | Steward | 297/156 |
| 1,768,427 | 6/1930 | Stevens | 297/172 X |
| 2,168,910 | 8/1939 | Merrill | 297/172 |
| 2,486,468 | 11/1949 | Freedman | 297/156 |
| 2,711,784 | 6/1955 | Kuschel | 297/242 |
| 2,771,706 | 11/1956 | Johnson | 248/449 |
| 2,889,869 | 6/1959 | Hoyt et al. | 297/217 X |
| 2,912,203 | 11/1959 | Townsend | 248/448 |
| 2,921,623 | 1/1960 | Humpheries et al. | 297/172 X |
| 3,244,450 | 4/1966 | Boutin | 297/156 |
| 3,599,962 | 8/1971 | Henry | 297/172 X |
| 3,601,443 | 8/1971 | Jones | 108/103 |
| 3,809,354 | 5/1974 | Phifer | 248/455 |

FOREIGN PATENT DOCUMENTS

| | | | |
|---|---|---|---|
| 774984 | 10/1934 | France | 297/156 |

*Primary Examiner*—James T. McCall
*Attorney, Agent, or Firm*—David Silverstein

[57] ABSTRACT

The invention relates to an artist's easel characterized by circular mobility around a fixed base.

11 Claims, 5 Drawing Figures

MOBILE EASEL AND SEATING MEANS

BACKGROUND OF THE INVENTION

It is well-known in the art to use a stationary support for holding a canvas in an upright position while an artist is painting or drawing on it. The artist's equipment has typically consisted of such a stationary support or easel for the canvas, a separate chair or stool for himself to sit on, and a separate tray or table for holding his paints, brushes, and other painting materials. For many purposes, however, this arrangement is highly unsatisfactory. If the artist desires to inspect the canvas from a different angle, he must either move the easel or move his chair. Repeated many times during the course of completing his painting, this seemingly simple operation can become tiring and frustrating. Should the artist decide to reposition himself to obtain a different perspective on his subject or should the artist decide to reposition the canvas to obtain better lighting, this entails moving the easel, his chair, and the paint tray. During such operations, there is always the possibility that the canvas may fall or the paints and brushes may spill. Again these seemingly simple readjustments can become frustrating when compounded time and again in the course of completing a painting. Although the prior art recognizes many types of adjustable supports, including some artist's easels — for example U.S. Pat. Nos. 3,512,745; 3,497,882; 3,370,821; 2,514,068; 438,856; and U.S. Pat. No. Des. 193,665 — not one of these patents even recognizes the particular problem addressed by this invention, that of providing increased mobility for the artist and his canvas.

OBJECTS OF THE INVENTION

Accordingly, it is the general object of this invention to provide an artist's easel having increased mobility.

It is specifically an object of this invention to provide an artist's easel having circular mobility around a fixed base.

A further object of this invention is to provide a circularly mobile artist's easel in which there is double rotation of a canvas support assembly and seating means either together or independently about a fixed base.

A further object of this invention is to provide a circularly mobile artist's easel including adjustable support means and adjustable storage means.

Another object of this invention is to provide a circularly mobile artist's easel which includes a sliding palette.

Still another object of this invention is to provide a circularly mobile artist's easel which includes an adjustable artist's mahlstick.

These and other objects and advantages of the present invention will become apparent from the following description.

BRIEF DESCRIPTION OF THE INVENTION

DESCRIPTION OF PREFERRED EMBODIMENT

Figure 1:
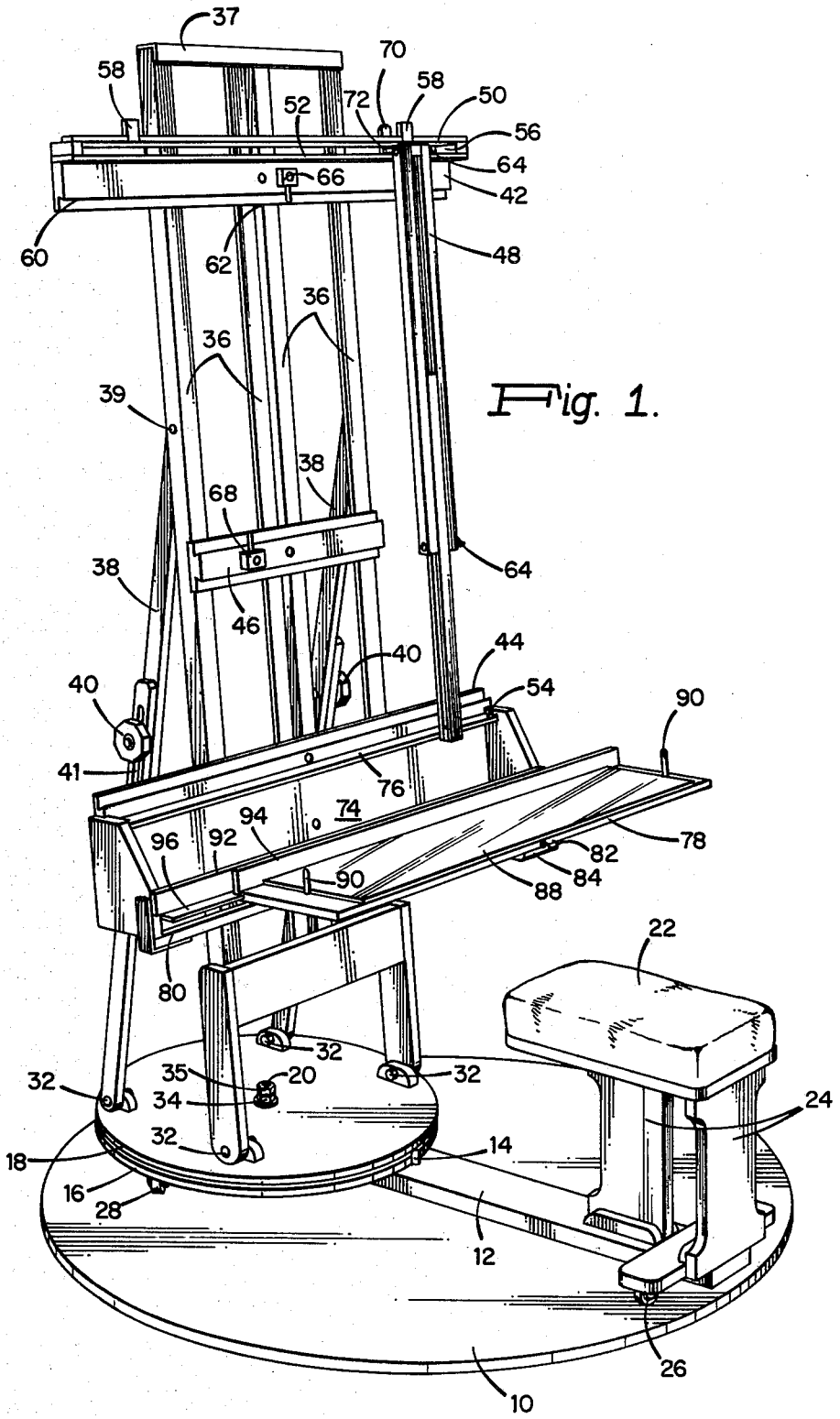
FIG. 1 is a front perspective view of the artist's easel of this invention.
Figure 2:
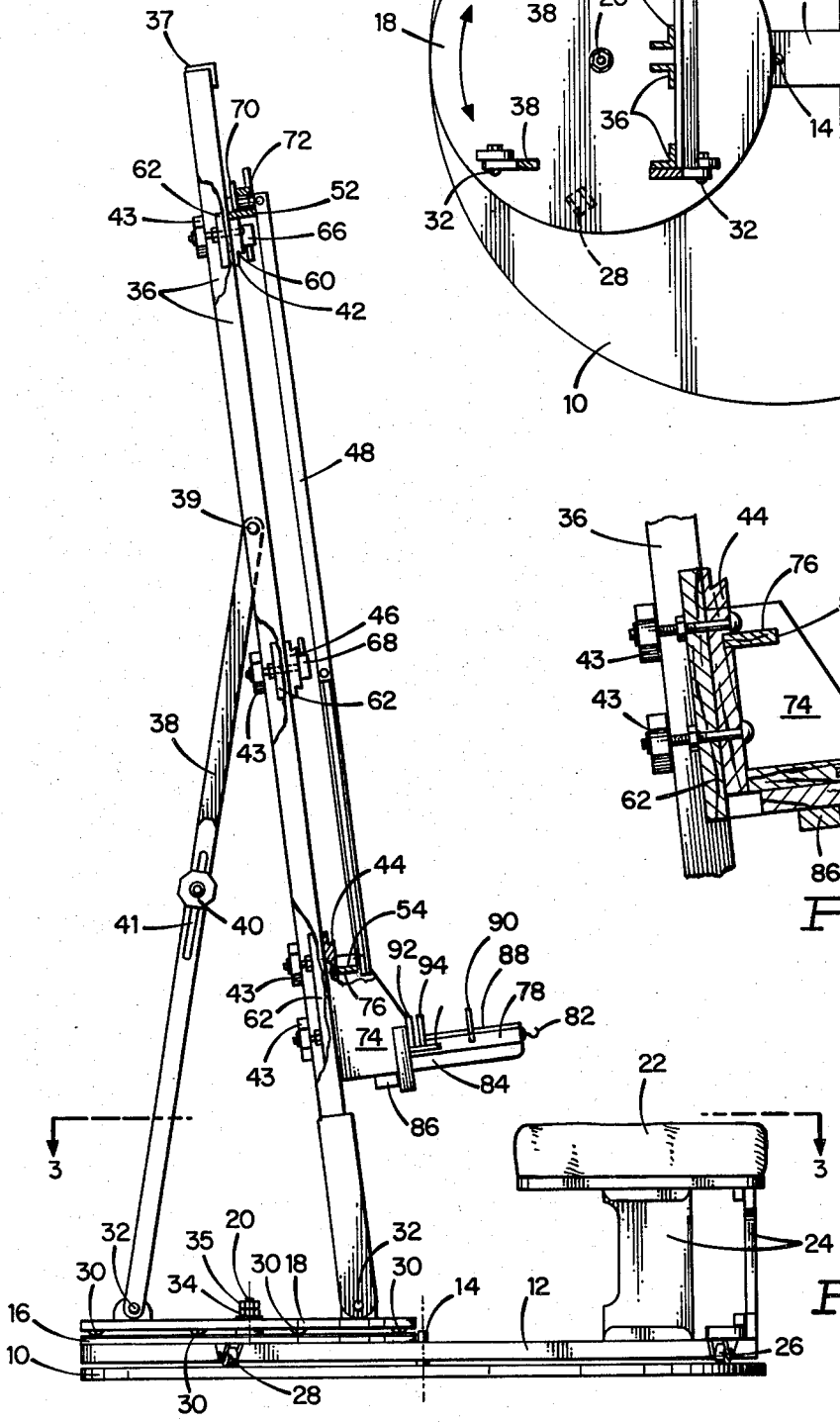
FIG. 2 is a side view of the artist's easel of this invention.

FIG. 1 is a front perspective view of the preferred embodiment of the artist's easel of this invention. The easel comprises a fixed base 10 which rests on the floor or any other relatively level and stable surface. An assembly support, in this case carrying beam 12, is rotatably mounted on fixed base 10 by means of an axle 14. At one end of carrying beam 12 is a lower canvas support base 16 and an upper canvas support base 18. The upper and lower canvas support bases are mounted on carrying beam 12 by means of axle 20. Lower canvas support base 16 is fixed to carrying beam 12 by any suitable means such as bolting them together. Upper canvas support base 18, however, may rotate about axle 20. The ease or difficulty with which upper canvas support base 18 rotates is controlled by the amount of tension applied by tension nut 34 on the threaded top of axle 20. Locking nut 35 positioned on top of tension nut 34 is used to maintain the desired degree of permanent tension. To facilitate rotation of upper canvas support base 18 about lower canvas support base 16, bearing means such as a plurality of nylon glides 30 as shown in FIG. 2 may be provided between the upper and lower canvas support bases. In addition, to facilitate rotation of carrying beam 12 around axle 14, casters 28 may be provided between lower canvas support base 16 and fixed base 10.

At the opposite end of carrying beam 12 from the upper and lower canvas support bases is mounted some sort of seating means, for example a cushioned seat 22 resting on seat supports 24. The seating assembly is likewise preferably provided with casters 26 to facilitate rotation of carrying beam 12 around axle 14.

The canvas support assembly is pivotally mounted on upper canvas support base 18 by pivot assemblies 32. The canvas support assembly itself comprises a plurality of upright column supports 36 and accompanying adjustable braces 38. The canvas support assembly may also include one or more stabilizing cross braces such as that shown at 37 at the top of FIG. 1. The column supports and braces are preferably made from lightweight metal such as aluminum or hard woods. By means of pivots 39 and 32 shown in FIG. 2 and knobs 40 riding in slots 41, the braces 38 may be adjusted to tilt the column supports 36 at any desired angle. This is often desirable, for example, when standing or when painting a large picture. Various angles are possible from vertical backward to an angle of about 18–20 degrees.

The canvas support assembly also comprises upper canvas holder 42 and lower canvas holder 44. Upper canvas holder 42 and lower canvas holder 44 may be raised or lowered along the center column supports 36 and held in place by means of knobs 43 as shown more clearly in FIGS. 2 and 4. By means of sleeves 62 vertically fixed to the back and center of upper canvas holder 42 and lower canvas holder 44, as shown more clearly in FIGS. 2 and 4, the upper and lower canvas holders may be laterally secured and prevented from "windmilling". The canvas may be secured in the desired position on the canvas holders by means of a movable canvas safety lock 66. It is also often desirable to provide a dual-edged auxiliary canvas holder 46, which is likewise adjustable by means of a knob 43. The auxiliary canvas holder 46 also includes a sleeve 62 and an accompanying movable canvas safety lock 68. The auxiliary canvas holder provides another convenience of major importance because it offers quick height adjustment of a canvas when changing from a sitting position to a standing position without interferring with the position of the palette or storage tray as described below. A painting may be positioned between the auxiliary canvas holder 46 and the upper canvas holder 42. When this position is desired the two canvas safety locks, 66 and 68, may be utilized. If the painting is positioned between the auxiliary canvas holder 46 and the lower canvas holder 44, canvas safety lock 68 may be used alone. There are infinite combinations of positions afforded by the three canvas holders all of which do not interfere with the ability to adjust the artist's mall as described below. All of the canvas holders may also advantageously include sloping grooves as shown at 60 for upper canvas holder 42 as safety locks for a gesso or canvas board.

Another important part of the canvas support assembly is the adjustable artist's mahlstick 48. The artist's mahlstick is used to steady the hand when painting detail work. It is adjustable and can be lengthened to cover a canvas of any suitable dimensions or closed up and used in conjunction with the upper canvas holder 42, it can be brought to bear over a canvas of very small dimensions. Its versatility is virtually unlimited, and it is truly a convenient feature. It is primarily constructed in two parts — the sleeve and the main mahlstick members (not separately numbered). The support pin 72 provides means for vertical suspension and the lip 70 on the tip of the support pin prevents the mahlstick from accidently falling out of the mahlstick's holding track 56. To remove the mahlstick from the holding track it is merely necessary to swing the mahlstick to the left or right to a parallel position with the holding track and remove it with a forward motion. The mahlstick can then be stored on storage rack 50 on top of the holding track 56, and it will be held in place by the mahlstick stops 58 fixed to the track top. The two wing nuts 64 are used for adjustment of the artist's mahlstick. If the top wing nut is left slightly loose the mahlstick can be lifted forward from the bottom and swung left or right without fear of it jamming the support pin in the holding track. When in use, mahlstick 48 is held away from the face of the canvas by upper mahlstick bearer 52 and lower mahlstick bearer 54. The lower mahlstick bearer can also double as a storage shelf 76 for paint brushes.

Still another part of the canvas support assembly of this invention comprises storage means for the convenient and accessible storage of paints, brushes and similar artist's materials. The preferred storage means comprises a storage tray 74 as the bottom portion of lower canvas holder 44. Storage tray 74 includes a shelf 76 as described above and, slidably attached to the tray, a palette 78. Palette 78 may be slidably attached to storage tray 74 by means of a tongue-and-groove palette guide 96. The details of the tray and palette assemblies as described below are shown more clearly on FIGS. 3 and 5. The tongue is fixed to the forward end of the storage tray bottom and protrudes into the groove on the palette. This arrangement provides a guide for the palette when sliding it left or right. It also provides support for the palette. Additional support for the palette is provided by the palette support tongue 84. The tongue support is fixed beneath the palette and protrudes through the opening provided by palette support beam 80. Fixed to the bottom of the tongue and positioned in back of the support beam is a stop or block 86 (seen only on FIGS. 2 and 5) that prevents the palette from becoming detached from the storage tray. The palette is separated from the inside of storage tray 74 by storage tray fence 92 and palette fence 94. The palette and storage tray fences provide necessary separation between one another and prevent the paints and fluids on the palette from flowing forward and on to the floor of the easel. Because of the forward and front position of the palette and storage tray another major convenience of this invention is evident. It is desirable that palette 78 have a glass top 88 for cleaning and visibility purposes as described below, and that pegs 90 be located at either end of the palette for holding cleaning cloths. Also, a convenient hook 82 may be provided along the outer edge of palette 78 for similar purposes.

FIG. 2 is a side view of the artist's easel of this invention. FIG. 2 shows more clearly the two sets of casters 26 and 28, nylon glides 30, pivots 32 and 39, and adjustment knobs 40 and 43.

Figure 3:
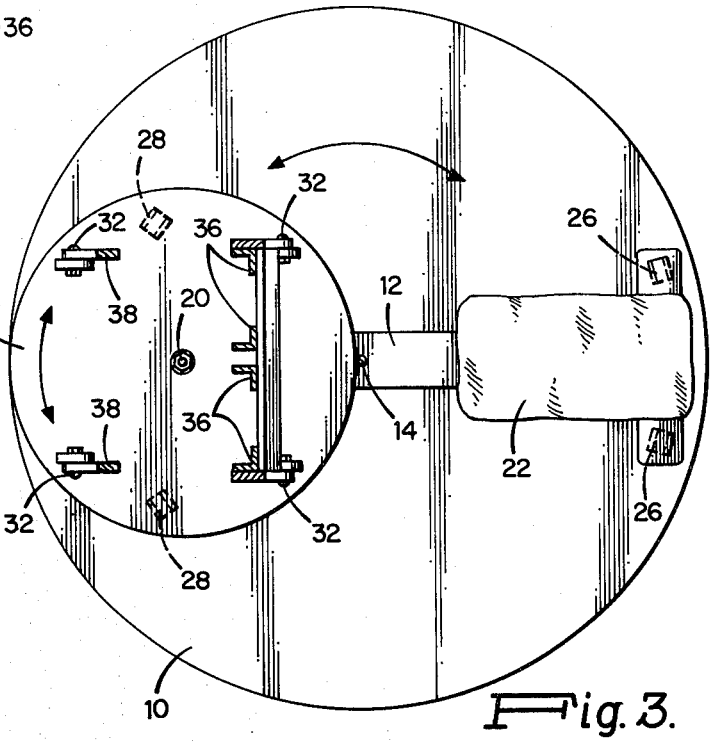
FIG. 3 is a top sectional view of the artist's easel of this invention.

FIG. 3 is a top sectional view of the artist's easel of this invention. FIG. 3 shows more clearly the disposition of carrying beam 12 on fixed base 10, and rotatable upper canvas support base 18 and seating means 22 on carrying beam 12.

Figure 4:
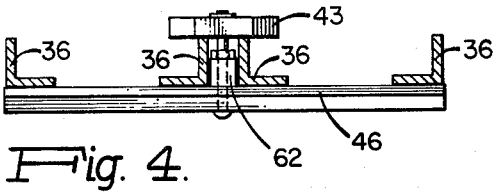
FIG. 4 is a sectional view of the support and knob assembly of the artist's easel of this invention.

FIG. 4 is a sectional view of the support and knob assembly of the artist's easel of this invention. FIG. 4 shows more clearly how sleeve 62 is fixed to the back of auxiliary canvas holder 46 so as to provide a degree of lateral stability for canvas holder 46, and how the canvas holder is vertically secured by means of knob 43 positioned between the center column supports 36. By similar means vertical adjustability and lateral stability is provided for upper canvas holder 42, lower canvas holder 44, and the tray and palette assembly.

Figure 5:
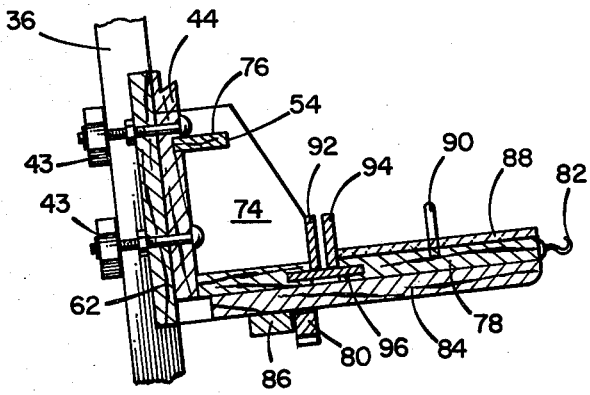
FIG. 5 is an enlarged sectional view of the storage tray and palette assembly of the artist's easel of this invention.

FIG. 5 is an enlarged sectional view of the storage tray and palette assembly of the artist's easel of this invention. FIG. 5 shows more clearly the tongue-and-groove palette guide 96, storage tray 74 and shelf 76, storage tray fence 92 and palette fence 94, palette support beam 80 and support tongue 84, the stop or block 86, and the pegs 90 and hook 82.

An artist's easel of the type herein described has numerous advantages over the artist's easels previously known. The most important feature of this invention is the advantage of double circular mobility. The seating means and canvas support assembly of this invention are either jointly or independently rotatable. For example, the seating means and canvas support assembly can move jointly with respect to fixed base 10 around axle 14. This type of movement is desirable, for instance, when the artist desires to view his subject from a different angle or desires to have the canvas catch the light from a different angle without shifting the relationship between the seating means and the canvas. Alternatively, the canvas support assembly can be independently rotated around axle 20 by rotating upper canvas support base 18. In this way, the artist can move the canvas with respect to his seat to capture a different perspective or lighting effect. These moves are accomplished quickly and easily with a minimum of effort on the part of the artist. Minor readjustments to obtain optimum effects pose no difficulties. There is little or no risk of upsetting the canvas.

Other important features of this invention are the storage tray and associated sliding palette. The storage tray provides a convenient and accessible place for storing paints, brushes and other materials. Because it moves together with the canvas, it eliminates the need for separately moving a storage table every time an adjustment or change of position is desired. There is no risk of upsetting a tray of paints and brushes. Three separate movements — seat, canvas, and storage table — are reduced to one simple adjustment by means of this invention. The palette which slides left or right one-half its width is another major convenience of this invention. It allows the paints on the palette to be brought close to the area on the canvas being painted. A hand-held palette may be used at any time but because the palette on the easel is large it becomes an excellent launching or base point for the paints.

An easy-to-clean feature of the palette is attained by placing white paper beneath the entire glass-top and then smearing the glass with a small amount of brush cleaning fluid on top of which is placed a length of plastic wrap. The smear causes excellent temporary adhesion of the plastic wrap to the glass palette. The plastic wrap is further held in place by spiking it over the two pegs that hold cleaning rags. When a clean-up of the palette becomes necessary, the plastic wrap is merely rolled up and discarded.

White paper is used beneath the glass because in this way the paints that will be placed on the prepared palette will have excellent color recognition.

There are special ways in which the various advantages and improvements of this invention cooperate so as to produce especially desirable results. For example, when a wide canvas is used and the artist prefers to sit while painting, the artist will witness one of the major conveniences of the easel while working on an area toward the extreme left or right of the canvas by utilizing the separate circular mobility of the easel to bring the end of the canvas forward and close to his person and at the same time turning on the seat toward that end. The palette can be slid toward that end of the canvas thus affording comfort and convenience as the paints on the palette will be in close proximity to that particular area on the canvas being worked on. Because this move may alter or destroy the proper light angle it can be quickly recovered by exerting a slight force on the floor of the easel with the foot thereby turning the entire structure around the major axle until the proper light angle has been found. The adjustable mall can also be slid toward this end if needed.

Alternatively, if the artist prefers to stand while painting the seat can be pushed out of the way to either side allowing the artist unobstructed access to the canvas, palette and the storage tray. With a slight force on the easel with either hand the artist can quickly locate the proper light as the easel will rotate around its major axle.

Having described the invention, what is claimed is:

1. An artist's easel comprising: a fixed base; canvas support means rotatably mounted on said fixed base wherein said canvas support means comprise upright column supports; horizontally mounted upper, lower and auxiliary canvas holders slidably mounted on said column supports; and a pivoted mahlstick slidably mounted on said upper canvas holder.

2. An artist's easel comprising: a fixed base; canvas support means rotatably mounted on said fixed base wherein said canvas support means comprise upright column supports; and storage means comprising a storage tray slidably mounted on said column supports for vertical mobility and a palette slidably mounted on said storage tray for horizontal mobility.

3. An artist's easel comprising: a fixed base; canvas support means rotatably mounted on said fixed base; and seating means rotatably mounted on said fixed base such that said canvas support means and said seating means are independently rotatable with respect to said fixed base and rotate in vertical cylindrical planes.

4. An artist's easel comprising: a fixed base; assembly support means rotatably mounted on said fixed base; seating means mounted on said assembly support means; and canvas support means rotatably mounted on said assembly support means wherein said canvas support means are mounted on an upper canvas support base which is rotatably mounted on a lower canvas support base which, in turn, is mounted on said assembly support means.

5. The artist's easel of claim 3 wherein said canvas support means and said seating means rotate together with respect to said fixed base.

6. The artist's easel of claim 4, wherein said seating means and said lower canvas support base ride on casters on said fixed base.

7. The artist's easel of claim 4 wherein said canvas support means are pivotally mounted to said upper canvas support base.

8. The artist's easel of claim 4 additionally including bearing means for facilitating the rotation of said upper canvas support base about said lower canvas support base.

9. The artist's easel of claim 4 wherein said canvas support means comprises upright column supports; horizontally mounted upper, lower and auxiliary canvas holders slidably mounted on said column supports; and a pivoted mahlstick slidably mounted on said upper canvas holder.

10. The artist's easel of claim 4 additionally including storage means.

11. The artist's easel of claim 10 wherein said storage means comprises a storage tray slidably mounted on said column supports and a palette slidably mounted on said storage tray.

* * * * *